United States Patent [19]

Kelly

[11] 4,020,732

[45] May 3, 1977

[54] PICK FOR STRINGED INSTRUMENTS

[76] Inventor: Fred Kelly, Box 471, Grayling, Mich. 49738

[22] Filed: Oct. 24, 1975

[21] Appl. No.: 625,469

[52] U.S. Cl. ..... 84/322
[51] Int. Cl.[2] ..... G10D 3/16
[58] Field of Search ..... 84/322

[56] References Cited

UNITED STATES PATENTS

| | | | |
|---|---|---|---|
| 557,293 | 3/1896 | Wahl | 84/322 |
| 1,184,561 | 5/1916 | Napoletano | 84/322 |
| 2,484,820 | 10/1949 | Galetzky | 84/322 |
| 3,442,169 | 5/1969 | Bowers | 84/322 |
| 3,789,720 | 2/1974 | McIntyre | 84/322 |

*Primary Examiner*—Lawrence R. Franklin
*Attorney, Agent, or Firm*—Lon H. Romanski

[57] ABSTRACT

A pick for use on stringed musical instruments is shown as having a main body portion which carries a tongue-like portion or extension effective for engaging the string or strings of a musical instrument. The body portion comprises a base the effective cross-sectional thickness of which is significantly greater than the cross-sectional thickness of the tongue-like portion or extension. In one form of the invention the pick is shown as being entirely integrally formed while in another form of the invention the pick is shown as being comprised of separate fabricated parts assembled to each other.

15 Claims, 11 Drawing Figures

PICK FOR STRINGED INSTRUMENTS

BACKGROUND OF THE INVENTION

Heretofore various picks for stringed musical instruments have been proposed by the prior art. Among some of the problems of such prior art picks is the difficulty in, for example, thumb picks, having the pick actually turn while being used and therefore not only alterning its proper position relative to the thumb but also to the strings of the instrument thereby adversely effecting the resulting tonal quality of the musical instrument. Another problem of the prior art picks is that the flexibility thereof, especially when tightly held as between fingers, is significantly reduced thereby making it a virtual impossibility to have a soft tonal sound resulting when the pick engages a coacting string.

Accordingly, the invention as herein disclosed and claimed is primarily directed to the solution of the above as well as other attendant problems.

SUMMARY OF THE INVENTION

According to the invention, a pick for stringed musical instruments comprises a pick body portion of relatively thick cross-sectional thickness carrying a tongue-like extension or portion of relatively thin cross-sectional thickness for engaging the strings of a musical instrument.

Various general and specific objects and advantages of the invention will become apparent when reference is made to the following detailed description considered in conjunction with the accompanying drawings.

BRIEF DESCRIPTION OF THE DRAWINGS

In the drawings, wherein for purposes of clarity certain elements and/or details may be omitted from one or more views.

DETAILED DESCRIPTION OF THE PREFERRED EMBODIMENTS

Figure 1:
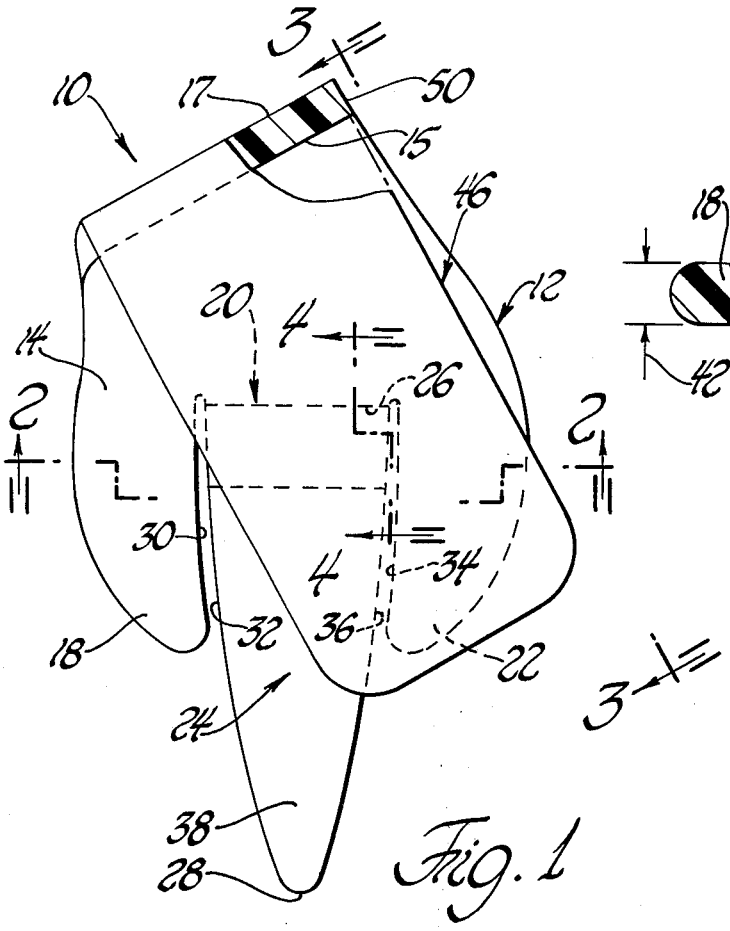
FIG. 1 is what may be considered a top plan view of a pick, with portions thereof broken away and in cross-section, embodying teachings of the invention.

Referring now in greater detail to the drawings, FIGS. 1, 2, 3 and 4 illustrate a pick 10 having a body or base 12 which, in the preferred form, in planar as to have planar upper (or inner) and lower (or outer) surfaces 14 and 16. As best viewed in FIGS. 1 and 2, the body or base 12 is comprised generally of integrally formed base portions 18, 20 and 22 with such, in FIG. 1, describing a generally inverted U-shaped configuration with base potions 18 and 22 extending as leg-like portions from base portion 20 which may be considered as a bight portion of such generally inverted U-shaped configuration integrally joining the leg-like extensions 18 and 22.

A blade-like extension 24 is formed integrally with medially disposed base portion 20, as at 26, and extends outwardly therefrom so as to have a free end 28 projecting a substantial distance beyond the ends of leg or arm portions 18 and 22 of body 12. Generally longitudinally extending clearance slots exist as between edge surface 30 of body portion 18 and edge surface 32 of blade 24 as well as between edge surface 34 of body portion 22 and edge surface 36 of blade 24. The provision of such longitudinal spaces enables full flexibility and movement by blade 24, as upon striking a string of a musical instrument, with the only and full support for the blade being provided at the juncture 26 of blade 24 and body portion 20.

Figure 2:
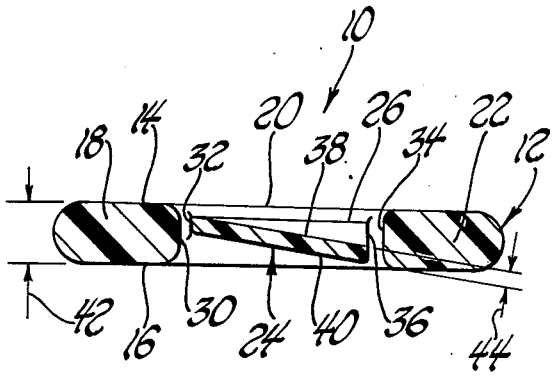
FIG. 2 is a cross-sectional view of the pick of FIG. 1 taken generally on the plane of line 2—2 and looking in the direction of the arrows.
Figure 4:
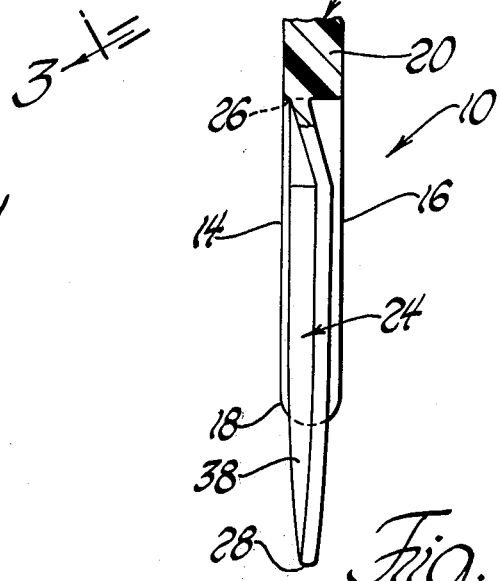
FIG. 4 is a fragmentary cross-sectional view taken generally on the plane of line 4—4 of FIG. 1 and looking in the direction of the arrows.

In the preferred form of the embodiment of the invention as shown in FIGS. 1, 2, 3 and 4 and as best shown in FIG. 2, the blade 24 is preferably formed as to its upper or inner surface 38 as well as its lower or outer surface 40 inclined at an angle with respect to the plane of the surface 14 of body 12. Further, as also best seen in FIG. 2, the cross-sectional thickness 42 of body 12 is substantially greater than the cross-sectional thickness 44 of blade 24. Also, as clearly shown by FIGS. 2, 3 and 4, it can be seen that the blade 24 is so situated as to have its upper and lower surfaces 38 and 40 contained within and respectively spaced inwardly from the planes passing through upper and lower surfaces 14 and 16 of base or body 12.

Figure 3:
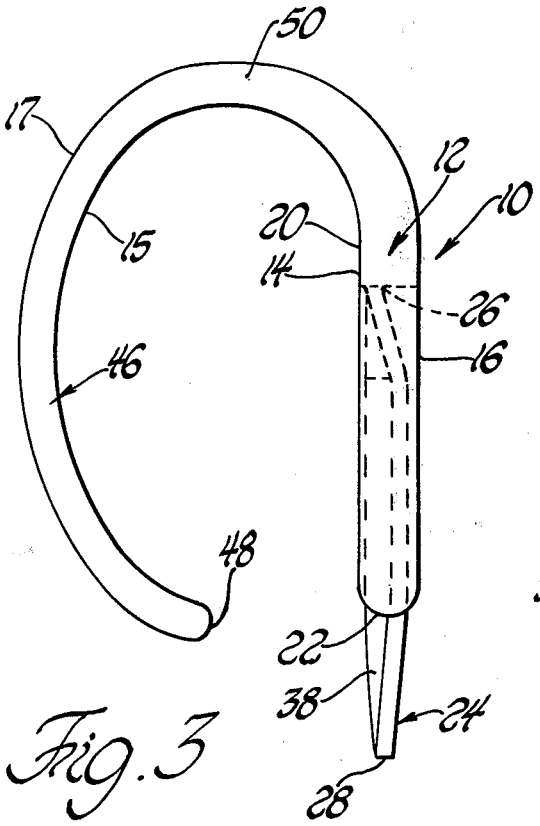
FIG. 3, is what may be considered a side elevational view taken generally on the plane of line 3—3 of FIG. 1 and looking in the direction of the arrows.

As shown in FIGS. 1 and 3, in the preferred form of the embodiment of the invention illustrated thereby, the body 12 has an integrally formed generally curled retainer portion 46 terminating as at an end 48 and overlying the base or body 12. The inner surface 15 of retainer 46 comprises an extension of surface 14 of base 12 while the outer surface 17 of retainer 46 comprises an extension of surface 14 of base 12 while the outer surface 17 of retainer 46 comprises an extension of surface 16 of body 12. The retainer 46 enables one playing the stringed musical instrument to wear the pick 10 on his thumb in a manner whereby the retainer would be situated on and against generally the outer side or portion of the thumb while the base 12 would be positioned on and against generally the inner side or portion of the thumb. The pick 10 as depicted in FIGS. 1, 2, 3 and 4 would be worn on the thumb of the right hand by one, of course, playing the stringed instrument with his right hand.

By providing a relatively thick body 12 carrying a relatively thin blade 24, the body 12 may be tightly gripped without any fear of breaking it (the prior art straight picks always being uniformly very thin) while still assuring a relatively high degree of flexibility in the blade 24 as to thereby enable the engagement thereof with a coacting instrument string in a melodious manner.

Further, by having the blade 24 contained within the space defined by the planes of surfaces 14 and 16 serves to preserve the integrity of flexibility of such blade 24 during use thereof. That is, since the upper surface 38 of blade 24 is spaced inwardly from upper surface 14 of base 12 (and in the preferred form the lower surface 40 of blade 24 is spaced inwardly from lower surface 16 of base 12) the player's finger may be pressed to a great degree against surface 14 of body 12 without any attendant undue influence upon the flexibility and action of the blade 24. Consequently, it then becomes possible to have the curled or ring-like retainer formed as to be effective to produce a much greater holding force against the wearer's thumb, and thereby prevent undesirable relative rotation or movement of the pick with respect to the thumb, without in any way producing any undesirable damping effect on the blade 24.

In view of the preceding, it can be seen that body 12 in effect not only provides the means for carrying the blade 24 but further defines and comprises a blade guard in that the body 12, as by its outwardly spaced upper and lower surfaces 14 and 16 as well as the generally laterally surrounding or juxtaposed body portions 18, 20 and 22, serves to protect and guard the blade 24 from any undue undesirable forces there against. Also, the forming or positioning of the blade 24 as to angularly inclined with respect to the body 12, as best seen in, for example, FIG. 2 provides another distinct benefit. That is, if one visualizes a performer using a pick having an angled blade as in FIG. 2 and playing, for example, a guitar, it can be seen that because of such a relative angled position of the blade the blade 24 will, on the downstroke across the guitar strings, engage the top-most or sixth string at a slight angle relative thereto (that is, the surface 40 will not be flat against the sixth string) while as the performers forearm and wrist both move downwardly and pivot the blade will engage the lower-most or first string of the guitar in a flat or parallel relationship (that is, the surface 40 will be flat against the first string). These relationships, of course, may vary slightly depending on the style, etc., of the individual playing the stringed musical instrument. Because of this, the resulting tonal quality of the music is enhanced. Further, the invention as embodied within a thumb pick, because of its ability in not in any way adversely effecting the flexibility of the blade, while securely holding itself to the individual's thumb, has the bi-directional action of a flat pick of the prior art (one which has to be held as between and by the forefinger and thumb) and is inherently capable of picking (engaging selective and/or sequential strings of the instrument) both in the upstroke direction (individuals hand or thumb moving generally in the direction from the lower-most or first string of a guitar to the top-most or sixth string of a guitar) and the downstroke direction (opposite to the said up-stroke direction) without in any way immobilizing the individual's forefinger by requiring such forefinger to in any way hold the pick.

As can be seen, in the preferred form of the thumb pick embodiment, as for example shown in FIG. 1, the bight or bowed portion 50 is preferably of reduced width, as compared to the overall width of the face 12, in order to thereby assure that resilient deflection will not occur in the base portion 12 when the pick is worn by an individual and that all such resilient deflection necessary for the accommodation of a wearer's thumb will occur generally as between the base 12 and end 48 of the retainer 46. Further, to enhance, localize and generally control such anticipated resilient deflection of the retainer portion 46 such portion 46, as well as bowed portion 50, may be further selectively contoured as in cross-sectional thickness to thereby be less and/or greater than the thickness of body 12 as viewed, for example, in FIG. 3.

Obviously, the pick may be formed of any suitable material; however, it has been discovered that various plastic materials are best suited. It has further been discovered that, among such suitable materials, acetal resin, a high melting, highly crystalline, thermoplastic polymer having a chemical structure represented by the formula $(—OCH_2—)_n$ is highly suited for forming the pick of the invention. In this connection it has also been discovered that an acetal resin derived by polymerization of formaldehyde and sold commercially under the trademark, Delrin, is particularly suitable in forming a pick according to the invention. Delrin acetal resin as tested by the ASTM (American Society of Testing Materials) under standard conditions possesses the following properties:

| PROPERTY | ASTM No. | VALUE |
|---|---|---|
| Tensile strength at 75° F. | D-6638 | 10,000 p.s.i. |
| Flexural modulus at 73° F. | D-790 | 410,000 p.s.i. |
| Specific gravity | D-7992 | 1.425 |
| Melting point (crystalline) | | 347° F. |
| Coefficicent of linear thermal expansion | D-696 | $4.5 \times 10^{-5}$ |
| Thermal conductivity | | 1.6 B.t.u./hr./sq.ft./° F./in. |

Another embodiment of the invention is illustrated in FIGS. 5, 6, 7 and 8. All elements and/or details in FIGS. 5–8 which are like or similar to those FIGS. 1–4 are identified with like reference numbers provided with a suffix *a.*

Figure 5:
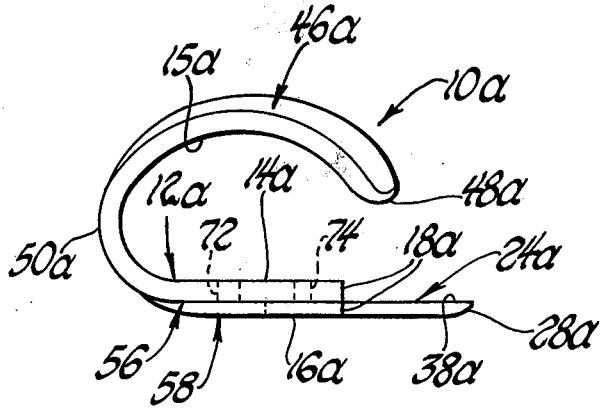
FIG. 5 is a side elevational view, in comparatively reduced scale, of a second pick embodying teachings of the invention.
Figure 6:
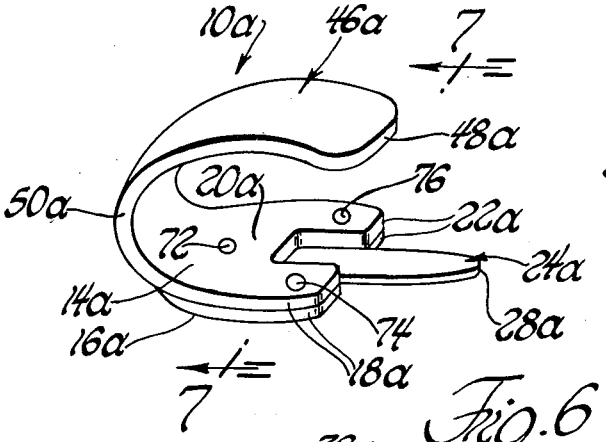
FIG. 6 is a perspective view of the pick of FIG. 5.
Figure 7:
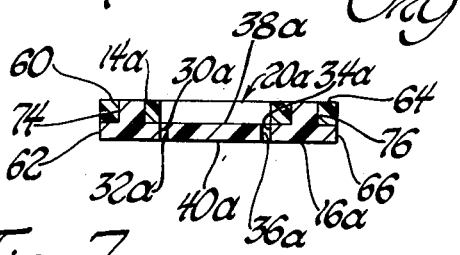
FIG. 7 is a cross-sectional view taken generally on the plane of line 7—7 of FIG. 6 and looking in the direction of the arrows.
Figure 8:
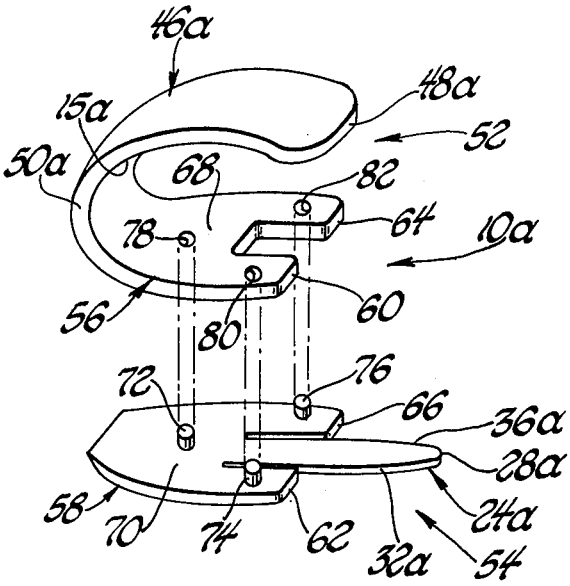
FIG. 8 is a perspective view illustrating the pick of FIGS. 5, 6 and 7 but depicting the elements thereof in generally exploded fashion.

Referring in greater detail to FIGS. 5–8, it can be seen that the pick 10*a* is comprised of generally two separate pick sections 52 and 54 and that, especially when assembled as generally depicted in FIGS. 5, 6 and 7, the body or base 12*a* is formed of upper or inner body section 56 and juxtaposed lower or outer body section 58. As best seen in FIG. 8, the leg or arm portions 18*a* and 22*a* of the body 12*a* are respectively formed of upper or inner and lower or outer juxtaposed leg or arm portions 60, 62 and 64, 66, while the bight portion 20*a* is formed of juxtaposed upper or inner and lower or outer bight portions 68 and 70. The blade 24*a* is integrally formed at its inner end with body section 58 in a manner as to have longitudinal slots defined by edge surfaces 30*a*, 32*a* and 34*a*, 36*a* on either side of the blade 24*a*. As is clearly evident in FIG. 7, blade 24*a* is free to flex and move between opposed arm or leg portions 60, 64 of upper body section 56.

A plurality of fastener means 72, 74 and 76 are provided for securing the body sections 56 and 58 to each other. Even though such fastener means may, of course, be any such suitable means, in the preferred form of the embodiment of FIGS. 5–8, fastener means 72, 74 and 76 are integrally formed with body section 58 which, in turn, is preferably formed of plastic material. When assembling the body sections 56 and 58 to each other, such may be accomplished by inserting the fastener pins 72, 74 and 76 into respective apertures 78, 80 and 82 formed in upper body section 56. In one aspect of the invention, it is contemplated that such pins 72, 74 and 76 may be tightly received within apertures 78, 80 and 82 as either by a press-fit or a snap-like detent action whereby body sections 56 and 58 would retain their assembled relationship during use while still enabling the user thereof to disassemble the body sections 56 and 58 from each other and possibly substitute for the lower body section 58 a second lower body section similar to the one removed but possibly having different mechanical or physical characteristics thereby resulting in a different tonal quality from the strings of the associated stringed musical instrument.

Another aspect of the invention contemplates the heat staking of the pins 72, 74 and 76 within apertures 78, 80 and 82 while still another aspect of the invention contemplates the use of a suitable adhesive, even as between body sections 56 and 58 for the cementing thereof into an assembly.

It should be noted that the embodiment of FIGS. 5, 6, 7 and 8 also provides a guard-like configuration similar to that of FIGS. 1–4. That is, the leg or arm portions 18*a* and 22*a* along with bight portion 20*a*, as well as the surface 14*a* defined thereby, serve to prevent the application of any undue undesirable forces against the blade 24*a*. Further, it can be seen, as shown for example by FIGS. 5 and 7, that surface 38*a* of blade 24*a* is spaced a substantial distance away from surface 14*a* against which, of course, the performer's finger would bear. Also, as shown by FIGS. 5–8, it is contemplated that the invention is not limited to the formation of an angularly inclined blade and that, in fact, surfaces 38*a* and/or 40*a* may be parallel to the plane of surface 14*a*.

Figure 9:
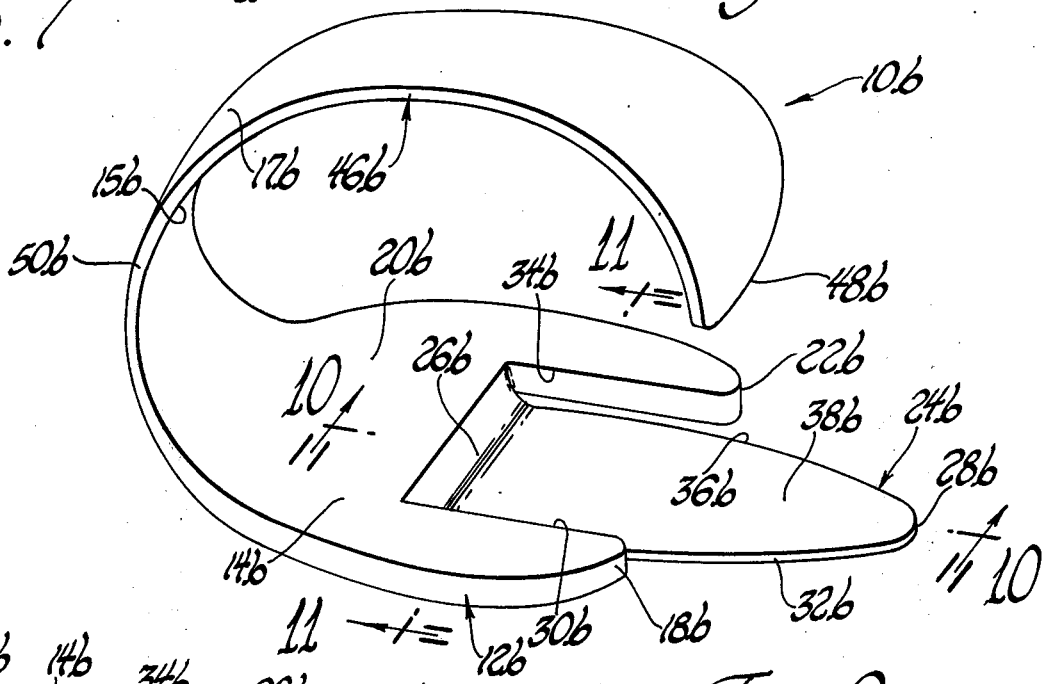
FIG. 9 is a perspective view of still another pick embodying teachings of the invention.
Figure 10:
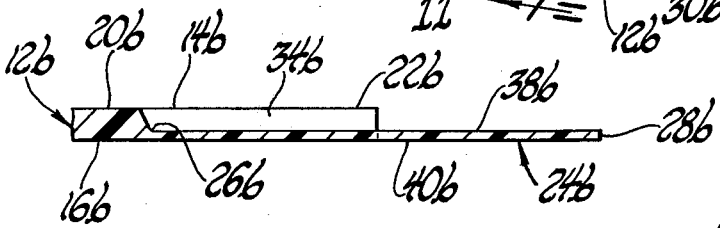
FIG. 10 is a fragmentary cross-sectional view taken generally on the plane of line 10—10 of FIG. 9 and looking in the direction of the arrows.
Figure 11:
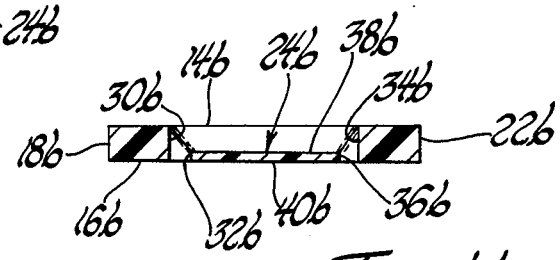
FIG. 11 is a cross-sectional view taken generally on the plane of line 11—11 of FIG. 9 and looking in the direction of the arrows.

FIGS. 9, 10 and 11 illustrate yet another embodiment of the invention. All elements in FIGS. 9, 10 annd 11 which are like or similar to those of any of FIGS. 1–8 are identified with like reference numbers provided with a suffix *b*.

Referring in greater detail to FIGS. 9, 10 and 11, it can be seen that in the illustrated embodiment surface 38*b* of blade 24*b* is parallel to the finger engaging body surface 14*b* and that blade 24*b* is integrally joined to body 12*b* and bight portion 20*b* thereof as at 26*b*. As in the preceding embodiments, the pick 10*b* of FIGS. 9, 10 and 11 is preferably formed of plastic.

Although only one preferred embodiment and selected modifications of the invention have been disclosed and described, it is apparent that other embodiments and modifications of the invention are possible within the scope of the appended claims.

I claim:

1. A pick for a stringed musical instrument, comprising a pick body, and a pick blade adapted for engaging a string of an associated stringed musical instrument, said pick body comprising first and second body portions spaced from each other and respectively having first and second free ends, said pick body further comprising a body bight portion joining said first and second body portions as to thereby define a generally U-shaped configuration with said first and second body portions comprising arms of said U-shaped configuration, said blade having a cross-sectional thickness and a width as to have said thickness of a dimension less than the average dimension of said width, said blade being operatively carried at one end thereof by said pick body and being so positioned as to be generally medially disposed between said first and second body portions as to have said width of said blade extending generally in the direction in which said first and second body portions are spaced from each other, said blade comprising a second free end opposite to said one end thereof and projecting a substantial distance beyond said first and second free ends of said first and second body portions and said cross-sectional thickness of said blade being significantly less than the cross-sectional thickness of said first and second body portions.

2. A pick according to claim 1 wherein said blade is integrally formed at said one end to said body.

3. A pick according to claim 1 wherein said first and second body portions cooperatively define a first upper surface against which a finger of a player of said associated musical instrument is placed during use of said pick, wherein said blade comprises a second upper surface, and wherein said second upper surface is angularly inclined with respect to said first upper surface.

4. A pick according to claim 1 wherein said blade comprises first and second oppositely disposed generally planar surfaces defining therebetween said cross-sectional thickness of said blade, said first and second generally planar surfaces terminating in first and second oppositely disposed longitudinally extending edges, wherein a portion of said first longitudinal edge extends the full length of said first body portion and is spaced from and juxtaposed thereto, and wherein a portion of said second longitudinal edge extends the full length of said second body portion and is spaced from and juxtapoed thereto.

5. A pick according to claim 1 wherein said body is formed from at least first and second upper and lower body sections operatively secured to each other.

6. A pick according to claim 5 further comprising securing means carried by at least one of said first and second upper and lower body sections for securing said upper and lower body sections to each other.

7. A pick according to claim 5 wherein said blade is integrally formed at said one end to said lower body section.

8. A pick according to claim 1 and further comprising a finger retainer portion operatively carried by said pick body and effective for detachably retaining said pick to the finger of a player of said associated musical instrument.

9. A pick according to claim 8 wherein said retainer portion comprises an elongated member of arcuate configuration having a first free end and a second end operatively connected to said pick body.

10. A pick according to claim 8 wherein said retainer portion comprises an elongated member of arcuate configuration defining a generally arcuate-like space generally between said elongated member and said pick body, said elongated member when viewed in a plane parallel to said pick body extending in a direction which is at an angle other than normal with respect to said blade.

11. A pick according to claim 8 wherein said retainer portion is integrally formed with said pick body.

12. A pick for a stringed musical instrument, comprising a pick body, and a pick blade adapted for engaging a string of an associated stringed musical instrument, said pick body comprising first and second body portions spaced from each other and respectively having first and second free ends, said pick body further comprising a body bight portion joining said first and second body portions as to thereby define a generally U-shaped configuration with said first and second body portions comprising arms of said U-shaped configuration, said blade being operatively carried at one end thereof by said pick body and being so positioned as to be generally medially disposed between said first and second body portions, said blade comprising a second free end opposite to said one end thereof and projecting a substantial distance beyond said first and second free ends of said first and second body portions, said first and second body portions cooperatively defining a first upper surface against which a finger of a player of said associated musical instrument is placed during use of said pick, said first and second body portions cooperatively defining a second lower surface formed thereon at a side of said first and second body portions opposite to said first upper surface, and said blade further comprising a third upper surface spaced from said first upper surface as to be generally between said first upper surface and said second lower surface.

13. A pick according to claim 12 wherein the cross-sectional thickness of said first and second body portions is substantially greater than the cross-sectional thickness of said blade.

14. A pick according to claim 12 wherein said third upper surface is angularly inclined with respect to said first upper surface.

15. A pick according to claim 12 wherein said blade comprises a fourth lower surface, and wherein said fourth lower surface is spaced from said second lower surface as to be generally between said first upper surface and said second lower surface.

* * * * *